US005943078A

United States Patent [19]

Nishimoto et al.

[11] Patent Number: 5,943,078

[45] Date of Patent: Aug. 24, 1999

[54] INK-JET PRINTING APPARATUS

[75] Inventors: Kazunari Nishimoto; Mitsuru Kurata, both of Kawasaki, Japan

[73] Assignee: Canon Kabushiki Kaisha, Tokyo, Japan

[21] Appl. No.: 08/566,582

[22] Filed: Nov. 28, 1995

[30] Foreign Application Priority Data

Nov. 30, 1994 [JP] Japan ..... 6-296930
Nov. 30, 1994 [JP] Japan ..... 6-296932

[51] Int. Cl.[6] ..... B41J 2/175

[52] U.S. Cl. ..... 347/89; 347/86

[58] Field of Search ..... 347/89, 86

[56] References Cited

U.S. PATENT DOCUMENTS

| | | | |
|---|---|---|---|
| 4,313,124 | 1/1982 | Hara . | |
| 4,345,262 | 8/1982 | Shirato et al. . | |
| 4,433,341 | 2/1984 | Thomas | 347/89 |
| 4,435,719 | 3/1984 | Snapper | 347/89 |
| 4,459,600 | 7/1984 | Sato et al. . | |
| 4,463,359 | 7/1984 | Ayata et al. . | |
| 4,558,333 | 12/1985 | Sugitani et al. . | |
| 4,608,577 | 8/1986 | Hori . | |
| 4,723,129 | 2/1988 | Endo et al. . | |
| 4,725,849 | 2/1988 | Koike et al. . | |
| 4,740,796 | 4/1988 | Endo et al. . | |
| 4,929,963 | 5/1990 | Balazar | 346/1.1 |

FOREIGN PATENT DOCUMENTS

| | | |
|---|---|---|
| 56-89565 | 7/1981 | Japan . |
| 62-53492 | 3/1987 | Japan . |
| 3-46589 | 7/1991 | Japan . |
| 5-212851 | 8/1993 | Japan . |
| 7-246713 | 9/1995 | Japan . |
| WO9211513 | 7/1992 | WIPO . |

OTHER PUBLICATIONS

"Ink Reconstitution For A Continuous Stream Ink Printing System", by P.J. Kim, Xerox Disclosure Journal, vol. 13, No. 3, May 1988, pp. 125–126.

"Drop Center Flow Meter", by J.W. Haskell, IBM Technical Disclosure Bulletin, vol. 16, No. 1, Jun. 1973, p. 249.

*Primary Examiner*—Valerie Lund
*Attorney, Agent, or Firm*—Fitxpatrick, Cella, Harper & Scinto

[57] ABSTRACT

Upon adjustment of an ink level of an air buffer in an ink supply system supplying an ink to a printing head via the air buffer from a sub-tank, by driving a pressuring motor of the sub-tank, the ink is fed under pressure. When the ink is reached at the position of a connection opening of the air buffer, the excess amount of ink is discharged for adjustment of the ink level. At this time, the ink discharged through the connecting opening is returned to the sub-tank via the ink tube. Thus, the ink consumed during the ink level adjustment can be avoided. With a construction set forth above, the shown case, the in the ink-jet cloth printing apparatus, in which the ink is supplied to the printing head via the air buffer, the ink amount to be consumed during the ink level adjustment of the air buffer is eliminated so that the ink consumption of the overall can be reduced.

12 Claims, 13 Drawing Sheets

INK-JET PRINTING APPARATUS

BACKGROUND OF THE INVENTION

1. Field of the Invention

The present invention relates generally to an ink-jet printing apparatus. More specifically, the invention relates to an ink-jet printing apparatus in which a cloth is used as a printing medium and ejecting and a liquid, such as an ink, is ejected on the cloth by employing an ink-jet head so as to perform cloth printing.

2. Description of the Related Art

Conventionally, an ink-jet printing apparatus has been employed as an information output means for an information processing system, such as a copy machine, a facsimile, an electronic typewriter, a wordprocessor, a workstation and so forth, or as an handy or portable output means for a personal computer, a host computer, an optical disk drive, a video apparatus and so forth.

Such ink-jet printing apparatus performs printing of characters and graphic images by ejecting fine droplet of ink through nozzles (hereinafter occasionally referred to as ejection openings). The ink-jet printing apparatus holds advantages of capavility of high resolution and high speed printing. Also, this type of printing apparatus is abruptly spreading for quietness owing to non-impact type printing, ease of color printing by employing multi color inks, and for ease of down-sizing and increasing of a density of pixels constituting a printed image.

Here, it should be appreciated that a word "print" includes providing of ink (printing, image forming, recording, dying and so forth). In view of this, the ink-jet printing apparatus is applicable not only for an information processing field, but also wide industrial fields, such as an apparel industry, in which cloth, yarn, paper, sheet material and so forth are employed as a printing medium receiving the ink.

A cloth printing apparatus employing an ink-jet system, as one example of application, is a technology becoming to be known in the recent years. The cloth printing in this system has advantages of great freedom in an image to be printed and of lower overall cost, because the cloth printing in the ink-jet system requires no original plate of the image to be printed as that required in screen cloth printing to provide. One example of a construction of such ink-jet type cloth printing apparatus has been disclosed in Japanese Patent Application Laid-open No. 212851/1993.

Incidentally, in the ink-jet cloth printing apparatus, it is sometimes required to change the ink depending upon kind of the cloth to be used and/or upon color to be printed. In such case, it becomes necessary to discharge the ink residing in an ink supply system, cleaning of the ink supply system and re-filling the ink supply system with a new ink to be used for next printing.

As discussed in commonly assigned Japanese Patent Application No. 38616/1994, the re-filling operation for the ink supply system is performed by employing a pressurizing mechanism provided in the ink supply system and the ink discharged from the ink supply system is performed by employing an external device. Also, in the above-identified commonly assigned Japanese Patent Application No. 38616/1994, there is described a construction in which, when the ink is changed for an other ink, overall ink supply routes are replaced so as not to require operations for discharging of the residual ink and cleaning of ink supply system.

As one example of the ink supply system in a conventional typical image forming apparatus employing the ink-jet head, an apparatus disclosed in Japanese Patent Application Laid-open No. 89565/1981 has been known. The shown ink supply system includes a first container for preliminarily storing ink to be supplied to a printing head and a second container which temporarily stores ink and which is provided in an ink route for supplying the ink in the first container to the printing head. Depending upon a remaining ink amount detected in the second container, a pump is driven to supply the ink from the first container to the second container to maintain the ink in the second container at a predetermined amount. As a counter measure for excessive supply of the ink caused when the ink from the first container is supplied to the second container, a construction coping with overflow is provided in the second container.

FIG. 1 is a diagrammatic illustration showing another example of the conventional ink supply system in the printing apparatus employing an ink-jet system.

An ink-jet head 1100 ejects, fine ink droplet downwardly in a drawing, through a plurality of ejection openings 1100*a*. Ink to be ejected by the head 1100 is supplied from a sub-tank 201 via a supply tubes 201*a* and 201*b*. To an ink supply passage constituted of the supply tubes 201*a* and 201*b*, an air buffer 202 is connected in series. As a result, influence of vibration to be generated in a ink supply system by movement associated with scanning of the ink-jet head 1100 is avoided to prevent ink ejection from becoming unstable to cause fluctuation of printing density and so forth.

In the sub-tank 201, a fan 207*a* is provided. The fan 207*a* is driven by a motor 207 to rotate to pressurize the ink within the sub-tank 201 for feeding through the supply tubes 201*a* and 201*b* under a pressurized condition. By this, in the tubes 201*a*, 201*b*, the ink-jet head 1100 and an ink tube 201*c*, recirculation of the ink is generated in the direction of a listed order. Thus, ejection failure of the ink due to generation of the bubble or plugging in the ink-jet head 1100 can be recovered or avoided. More specifically, a bubble within the head may be returned to the sub-tank 201 through the ink tube 201*c*. Also, the ink being in the vicinity of the ejection opening and having increased viscosity is discharged out of the ejection opening due to slight elevation of the pressure due to recirculation as set forth above.

In the air buffer 202, an air discharge opening 202 is provided for maintaining an air amount therein constant. More specifically, in the case that the air amount in the air buffer becomes greater than or equal to a predetermined amount, an air valve 203 is regularly opened when the ink is pressurized by driving of the pressurizing motor 207 to discharge the air through a discharge tube 204 so that the air amount is kept at a constant amount. At this time, when the air amount is appropriate, the ink is discharged through the discharge tube 204. Therefore, the ink level can be constantly maintained.

An ink cartridge 205 which is mounted on the sub-tank 201 is adapted to make the ink flow out when the ink level of the sub-tank 201 descents fellow a lower end of an ink supply tube of the ink cartridge 205. By this, the ink level in the sub-tank 201 can be constantly maintained so that, a negative pressure acting in the ink-jet head can be maintained constant to allow constant ink supply.

It should be noted that the ink-jet head 1100 is detachably loaded with respect to the ink supply system shown in FIG. 1. Therefore, upon exchanging of the head, the head is disconnected at the portion of a connector 206, and exchanged with another head.

However, in either of the ink supply systems of the foregoing two prior art, various problems are encountered as discussed below. In case of the prior art illustrated in FIG. 1, the air buffer is arranged at the intermediate position in the ink supply system in view of stability of ejection of ink. With such constriction, in order to perform liquid level control within the air buffer, a part of ink is inherently discharged together with the air from the apparatus, upon discharging the air. Therefore, an amount of ink to be consumed other than actual printing becomes relatively large to be a cause of rising of the running cost.

Also, as a problem in the conventional construction as set forth above, problems associating with exchanging of the ink-jet head may be arisen. More specifically, upon exchanging of the head, it is required to remove a head filling material as storage liquid sealed in the head for the purpose of certainly provide storing ability in the product distribution, by means of an external jig. In the operation, the filling liquid is exchanged with the ink to be used in the head. Therefore, it is typical to provide a plurality of external jigs, number of which should correspond to the number of colors of the inks so as to avoid color mixing in the ink. This results in high cost. Also, since the jig is used only for exchanging the ink, the ink within the jig may cause fatigue during relatively long interval of exchanging of the ink. In such fatigue ink is used for printing, it may be a cause for lowering of the image quality.

In addition to the problems relating to the construction of the ink supply system as set forth above, problems are arisen by employing the ink supply system with the two containers as in the foregoing prior art in the cloth printing apparatus. More specifically, in the cloth printing apparatus, for the reason of relatively large printing area, a plurality of ink-jet heads each having relatively large number of ink ejection openings are provided, and continuous printing is performed on an elongated cloth. Therefor, the ink consuming amount becomes much greater than a general printer used in an office or so forth. In this case, since it is typical to limit the size of the container within a given range with respect to the cloth printing apparatus, it is frequently caused to supply the ink from the first container to the second container. In such case, in the conventional ink supply system, it is possible to cause overflow of the ink from the second container similarly to the foregoing problem. If the overflown ink is disposed as waste ink, it becomes quite wasteful. On the other hand, when the overflown ink is stored in another container, an extra space becomes necessary. Furthermore, it becomes necessary to provide a construction to return the collected ink to the first container.

Also, as a further problem, upon changing the ink in the above-mentioned cloth printing apparatus, a troublesome operation becomes necessary to discharge the residual ink in the ink supply system and subsequently re-fill new ink after cleaning the ink supply system. Also, in case that a plurality of sets of ink supply systems are combined in place of exchanging of the ink, the cost for the apparatus is risen corresponding to number of the sets to be provided.

SUMMARY OF THE INVENTION

Therefore, it is an object of the present invention to provide an ink-jet printing apparatus which can reduce an unnecessary ink consuming amount by returning an ink which has been discharged out of the apparatus in the prior art, to the ink tank with a simple construction.

Another object of the present invention to provide an ink-jet printing apparatus which can improve operability of the apparatus, quality of the printed image and simplify the construction of the apparatus, by employing a construction to perform discharging of a filling material in an ink-jet head and re-filling of an ink to be used within the apparatus.

A further object of the present invention to provide an ink-jet printing apparatus which can easily achieve the foregoing two objects and permits establishment of a total system including a recovering operation of the ink-jet head.

A still further object of the present invention is to provide an ink-jet printing apparatus, in which an ink level in an air buffer is adjusted at a level of an ink level adjusting discharge opening to keep the ink level therein constant, and the ink discharged through the discharge opening can be guided into a position where an ink supply means may supply such ink, and whereby the discharge ink may be again used for ink supply.

A yet further object of the invention is to provide an ink-jet printing apparatus, in which the ink is recirculated through the ink supply passage including an ink supply path and an ink return path and the ink return path is closed by a valve, the ink is fed under pressure by a pressurizing means in the condition where the ink return path is closed by the valve so that the filler material in the ink-jet head which is newly loaded can be discharged out of the apparatus through the discharge opening and the ink may be filled in the head.

In a first aspect of the present invention, there is provided an ink-jet printing apparatus using an ink-jet head and performing printing to a printing medium by ejecting an ink from the ink-jet head, comprising:

- an ink supply means for supplying the ink to the ink-jet head;
- an ink container connected to an ink supply path between the ink supply means and the ink-jet head and storing the ink supplied through the ink supply path; and
- a guide means for guiding the ink discharged through an ink discharge opening of the ink container to a portion where the ink can be supplied by the ink supply means.

In a second aspect of the present invention, there is provided an ink-jet printing apparatus using an ink-jet head and performing printing to a printing medium by ejecting an ink from the ink-jet head, comprising:

- an ink supply means for supplying the ink to the ink-jet head;
- an ink supplying path for supplying the ink from the ink supply means to the ink-jet head;
- an ink returning path for discharging the ink from the ink-jet head to a portion where the ink can be supplied by the ink supply means;
- an ink container connected to the ink supplying path and storing the ink supplied through the ink supplying path;
- a guide means for guiding the ink discharged through an ink discharge opening of the ink container to a portion where the ink can be supplied by the ink supply means;
- a pressurizing means for pressurizing the-ink within the ink supplying path, the ink-jet head and the ink returning path; and
- a valve connected to the ink returning path and opening and closing the ink returning path.

In a third aspect of the present invention, there is provided an ink-jet printing apparatus using an ink-jet head and performing printing to a printing medium by ejecting an ink from the ink-jet head, comprising:

- an ink supply means for supplying the ink to the ink-jet head;
- an air buffer connected to an ink supplying path between the ink supply means and the ink-jet head and storing a predetermined constant amount of air therein; and a guide means for guiding the ink discharged through an ink discharge opening of the air buffer for adjustment of an ink level in the air buffer to a portion where the ink can be supplied by the ink supply means.

The guide means may have a discharging path connected to the ejection opening for ink level adjustment, and has a valve for opening and closing the discharging path therein.

In a fourth aspect of the present invention, there is provided an ink-jet printing apparatus using an ink-jet head and performing printing to a printing medium by ejecting an ink from the ink-jet head, comprising:

an ink supply means for supplying the ink to the ink-jet head;

an ink supplying path for supplying the ink from the ink supply means to the ink-jet head;

an ink returning path for discharging the ink from the ink-jet head to a portion where the can be supplied by the ink supply means;

a pressurizing means for pressurizing the ink within the ink supplying path, the ink-jet head and the ink returning path; and a valve connected to the ink returning path and opening and closing the ink returning path.

The valve may be a three-way valve, in which when the ink returning path is closed, a part at an ink-jet head side of the ink returning path is connected to the ink supplying path.

In a fifth aspect of the present invention, there is provided an ink-jet printing apparatus using an ink-jet head and performing to a printing medium by ejecting an ink from the ink-jet head, comprising:

an ink supply means for supplying the ink to the ink-jet head;

an ink supplying path for supplying the ink from the ink supply means to the ink-jet head;

an ink returning path for discharging the ink from the ink-jet head to a portion where the ink can be supplied by the ink supply means;

an air buffer connected in the ink supplying path and storing a predetermined constant amount of air;

a guide means for guiding the ink discharged from an ink level adjusting discharge opening of the air buffer to a portion where the ink can be supplied by the ink supply means;

a pressurizing means for pressurizing the ink within the ink supplying path, the ink-jet head and the ink returning path; and a valve connected to the ink returning path and opening and closing the ink returning path.

The valve may be a three-way valve, in which when the ink returning path is closed, a part at an ink-jet head side of the ink returning path is connected to the ink supplying path.

The guide means may have a discharge path connected to the ink level adjusting discharge opening, a valve for opening and closing the discharge path, and the discharge path and a part of the ink returning path are in common.

In a sixth aspect of the present invention, there is provided an ink-jet printing apparatus using an ink-jet head and performing printing to a printing medium by ejecting an ink form the ink-jet head, comprising:

a supply tank storing an ink to be supplied to the ink-jet head;

a supplementing tank storing an ink to be supplemented to the supply tank;

a supplementing path provided between the supplementing tank and the supply tank;

a supplementing means for feeding the ink from the supplementing tank to the supply tank via the supplementing path; and an excess ink path for guiding an excessive ink exceeding a predetermined level of the ink to the supplementing tank.

An ink-jet printing apparatus may further comprise an atmosphere communication path which is connected to the supplementing path and trough which the supplementing path communicates to an atmosphere via valve, and the atmospheric pressure is introduced into the supplementing path by the supplementing means in a condition communicated with the atmosphere.

A supply path may be provided between the supply tank and the ink-jet head, the supply path is branched from the supplementing path, and a valve for opening and closing the supplementing path is provided at a supplementing means side of a junction of the supplementing path.

A valve for opening and closing the supply path may be provided therein.

Another supply path may be provided between the supply tank and the ink-jet head.

In a seventh aspect of the present invention, there is provided an ink-jet printing apparatus as claimed in claim 16, comprising a plurality of sets of the supply tank, the supplementing path, the excess ink path, the atmosphere communicating path, the junction, the valve and another supply path, the ink being supplied from a single supplementing tank to the plurality of sets.

BRIEF DESCRIPTION OF THE DRAWINGS

The present invention will be understood more fully from the detailed description given herebelow and from the accompanying drawings of the preferred embodiment of the invention, which, however, should not be taken to be limitative to the present invention, but are for explanation and understanding only.

In the drawings.

DESCRIPTION OF THE PREFERRED EMBODIMENT

The preferred embodiments of the present invention will be discussed hereinafter in detail with reference to the accompanying drawings. In the following description, numerous specific details are set forth in order to provide a thorough understanding of the present invention. It will be obvious, however, to those skilled in the art that the present invention may be practiced without these specific details. In other instance, well-known structures are not shown in detail in order to unnecessary obscure the present invention.

(1) Explanation of Overall Construction of Apparatus

Figure 1:
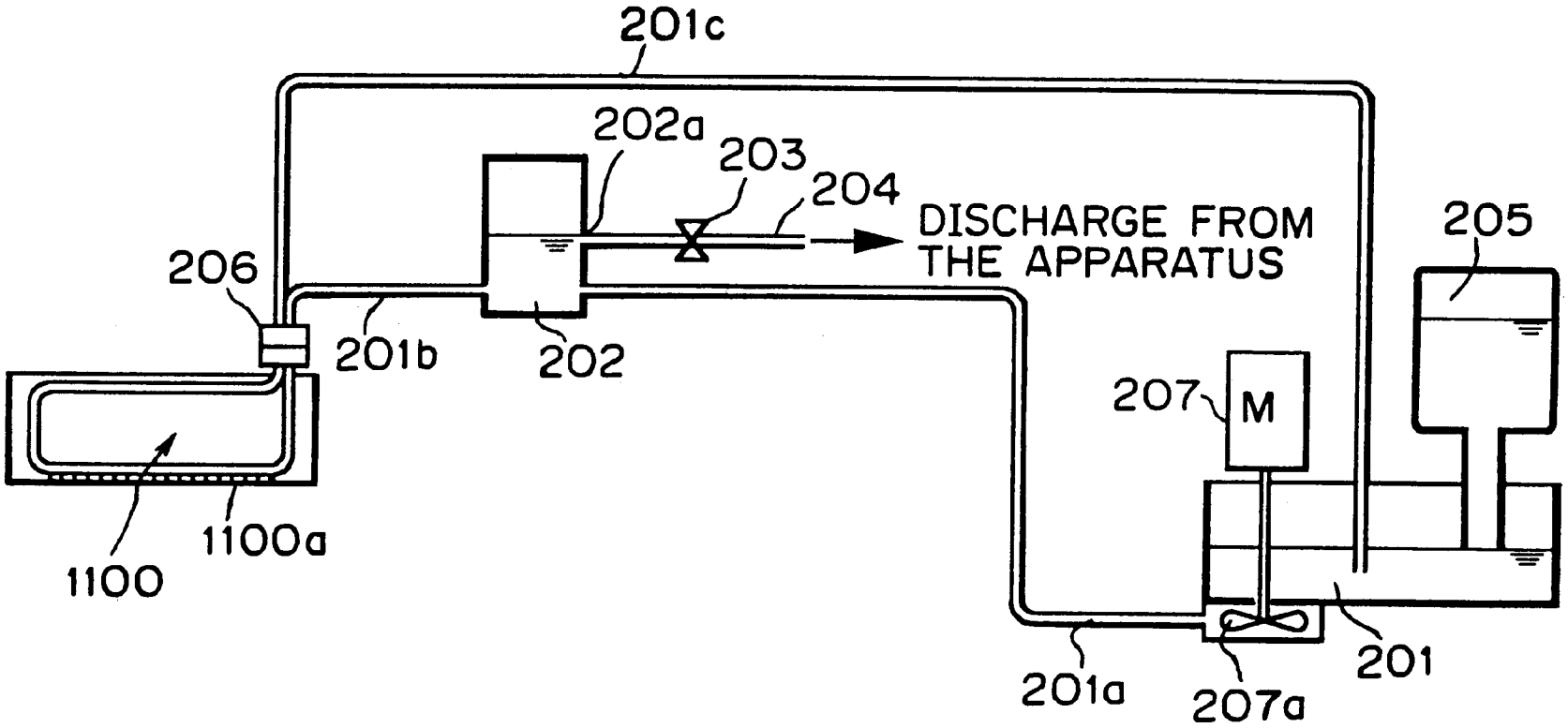
FIG. 1 (PRIOR ART)
FIG. 1 is a diagrammatic illustration showing the conventional ink supply system.
Figure 2A:
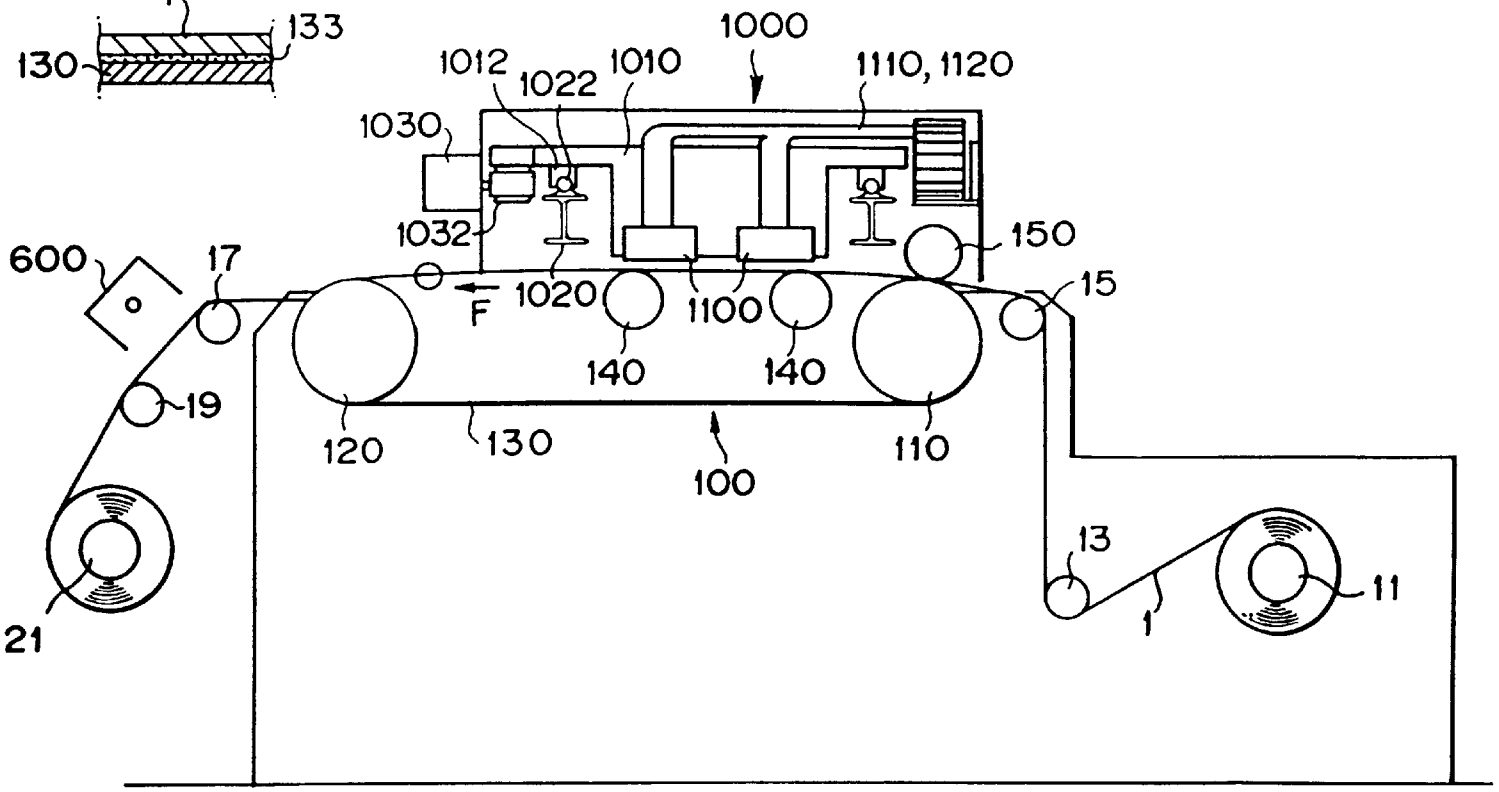
FIG. 2, consisting of FIGS. 2A and 2B, the latter being a close-up view of the transporting belt shown in FIG. 2A, is a side elevation diagrammatically showing one embodiment of an ink-jet printing apparatus according to the invention.
Figure 2B:
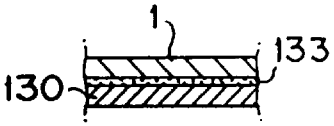

As one example of an ink-jet printing apparatus, for which the present invention is applied, a general constriction of a cloth printing apparatus is illustrated in FIG. 2. In this drawing, the reference numeral 1 denotes a cloth as a medium to be printed (printing medium). The cloth 1 is extracted according to rotation of a feeding roller 11 and fed in substantially horizontal direction by a transporting portion 100 which is arranged in opposition to a printing portion 1000 via intermediate rollers 13 and 154, and then taken up by a take-up roller 21 via a feed roller 17 and an intermediate roller 19.

The transporting portion 100 has transporting rollers 110 and 120 provided at upstream side and downstream side of the printing portion 1000, a transporting belt 130 in a form of an endless belt wound between the rollers 110 and 120, and a pair of platen rollers 140 applying an appropriate range of tension for the transporting belt for restricting a surface of the cloth to be printed in flat upon printing by the printing portion 1000 and improving the flatness of the surface to be printed. Here, in the shown embodiment, the transporting belt 130 is a metal belt as disclosed in Japanese Patent Application Laid-open No. 212851/1993. As disclosed in a partially enlarged fashion, the transporting belt 130 is provided with an adhesive layer (sheet) 133 on the surface thereof. The cloth 1 is adhered on the transporting belt 130 by the adhesive layer 133 by means of a depression roller 150. Thus, a flatness of the cloth upon printing can be assured.

To the cloth 1 which is transported under the condition where the flatness is assured, an ink as printing agent is provided by the printing portion 1000 within a region between a pair of platen rollers 140. Then, at the position of the transporting roller 120, the printed cloth is peeled off the transporting belt 130 or the adhesive layer 133 and taken-up by the take-up roller 21. During travel to the take-up roller, a drying process by a drying heater 600 is performed for the cloth. It should be noted that, as the drying heater 600, a heater blowing a hot air to the cloth, irradiating a infrared light on the cloth or of any appropriate form may be employed.

(2) Explanation of Printer Construction

Figure 3:
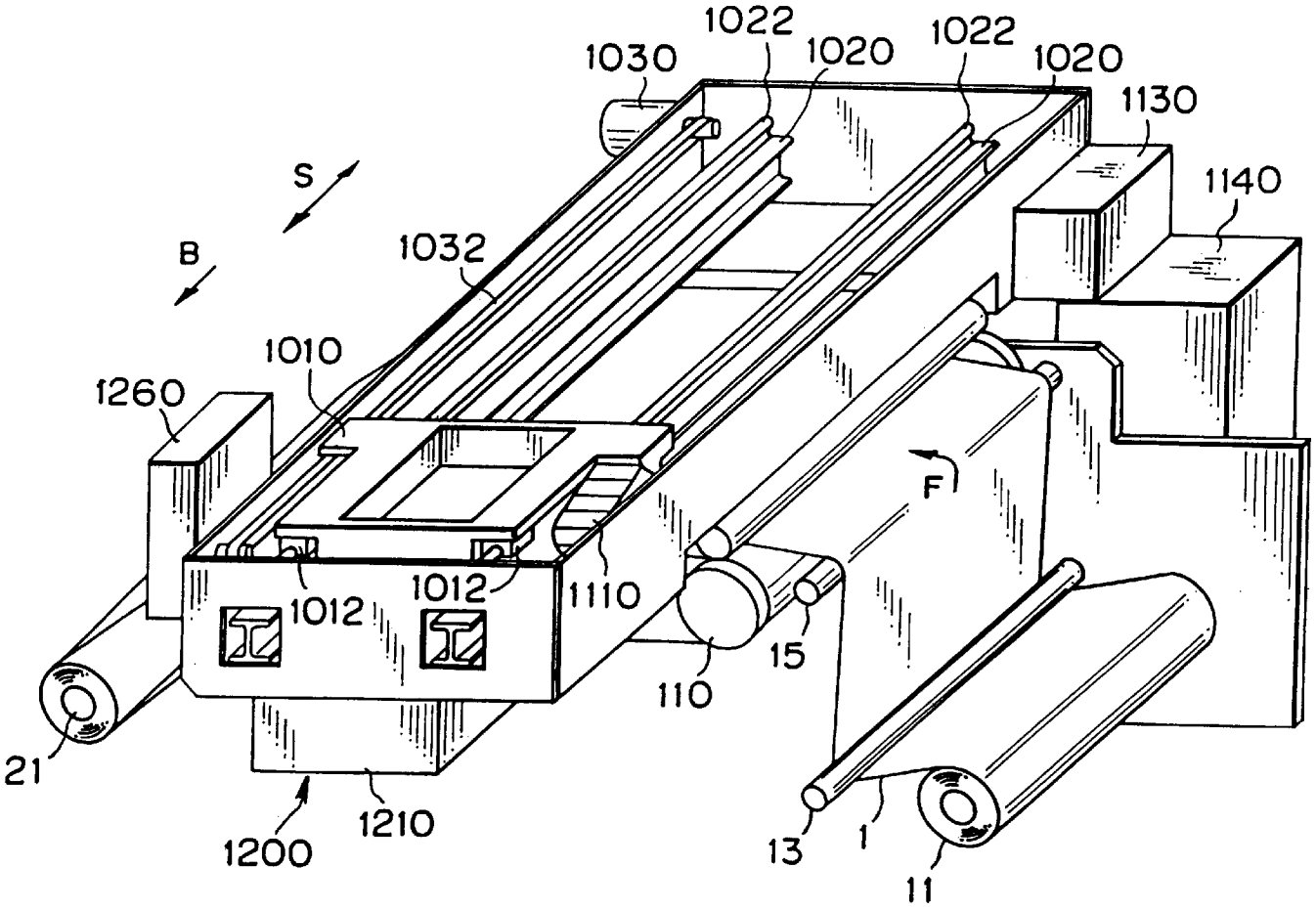
FIG. 3 is a perspective view diagrammatically showing a printing unit and feeding system in an ink-jet cloth printing apparatus.
Figure 4:
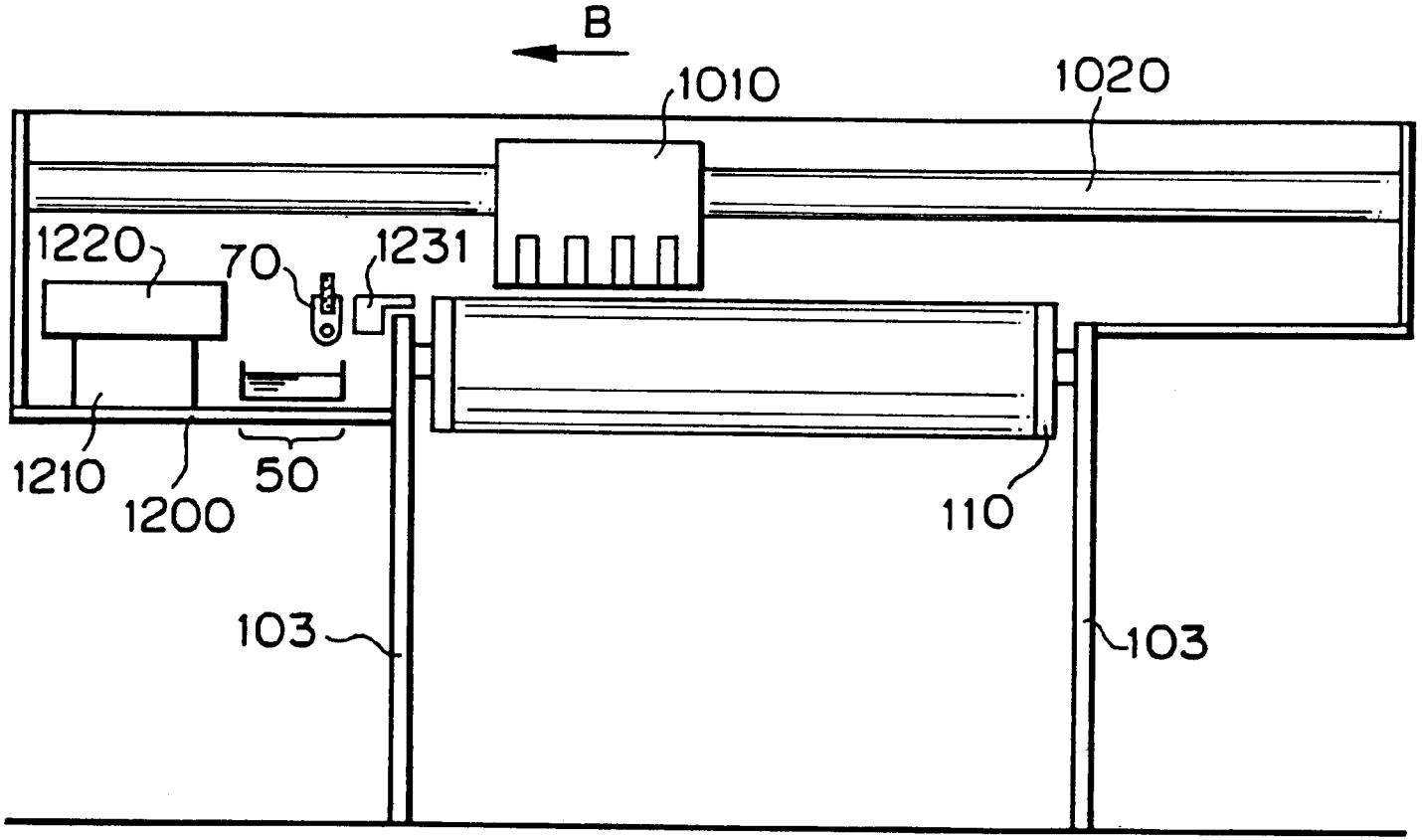
FIG. 4 is a diagrammatic front elevation of the ink-jet cloth printing apparatus.

FIG. 3 is a perspective view diagrammatically showing the printing portion and a transporting system of the cloth, FIG. 4 is a section showing a scanning system of the carriage. The construction of the printing portion 1000 will be discussed hereinafter with reference to FIGS. 2, 3 and 4.

At first, in FIGS. 2 and 3, a printing portion 1000 has a carriage 1010 scanning in a direction different from a transporting direction F (hereinafter also referred to as auxiliary scanning direction) of the cloth 1, for example width direction S of the cloth perpendicular to the transporting direction F. 1020 denote support rails extending in S direction (hereinafter also referred to as a primary scanning direction), which are supported on slide rails 1022. The slide rails 1022 support and guide sliders 1012 fixed on the carriage 1010. 1030 denotes a motor forming a driving source for performing primary scanning of the carriage 1010. The driving force is transmitted to the carriage 1010 via the belt 1032 and other appropriate transmission mechanism.

The carriage 1010 holds a plurality of printing heads 1100, in each of which a plurality of ink ejection openings are arranged in a predetermined direction (transporting direction F in the shown case). The printing heads 1100 are arranged in the direction different from the direction other than the predetermined direction (primary scanning direction S in the shown case). In the shown embodiment, a plurality of printing heads 1100 are arranged in two stages. In each stage, a plurality of the printing heads 1100 are provided corresponding to mutually different colors of inks. By this, it becomes possible to perform color printing. Number of the colors of the ink and the printing heads can be selected appropriately depending upon images and so forth to be formed on the cloth 1. For example, three primary colors of printing, i.e. yellow (Y), magenta (M) and cyan (C), in addition of black (Bk) may be used. On the other hand, in place of these, or together with these, special color (metallic colors, such as gold, silver, clear red or blue and so forth) difficult to be expressed by the three primary colors may be employed. In the alternative, even in the same color, a plurality of inks of mutually different density may be employed.

In the shown embodiment, as shown in FIG. 2, the plurality of printing heads 1100 arranged in the primary scanning direction S are provided in two stages in the transporting direction F. The ink color, number of the printing heads, the order of arrangement of the printing head and so forth may be the same in respective stage or may be differentiated to each other. On the other hand, it is possible to perform printing again by printing heads of the next stage with respect to the region to be printed by the primary scan of the first stage printing head (either complementarily printing by thinning printing for respective stages of the printing heads or overlapping printing). On the other hand, it is possible to perform high speed printing by sharing printing regions. Furthermore, the stage of the printing head is not limited to two stages but can be one stages or three stages.

In the shown embodiment, the ink-jet head as the printing head 1100, for example a bubble jet head having a heating element generating a heat energy generating a film boiling in the ink utilizing as energy for ejection of the ink, is employed. Then, for the cloth 1 transported in substantially horizontal direction by the transporting portion 100, by employing the condition where the ink ejection openings are oriented downwardly to eliminate difference of meniscus between respective ejection openings to make it possible to excellent quality of image by making the ejecting condition uniform, and to make uniform recovering process for all of the ejection openings possible.

In FIG. 4, a capping means 1220 is in contact with an ejection opening forming surface of each printing head during in non-printing state for avoiding drying and penetration of the dust or for removing them. In concrete during non-printing state, the printing head 1100 is moved to the position in opposition to the capping means 1220. Then, the capping means 1220 is driven in the capping direction by a driving means 1210 and performs capping by depressing an elastic member or so forth onto the ejecting opening forming surface.

A plugging preventing means 1231 is adapted to receive ejected ink in ejecting operation (which will be referred to "preparatory ejecting operation") for making ejecting condition of the printing head 1100 uniform by ink refreshing. The plugging preventing means 1231 is provided at the position opposing to the printing head in the region out of the printing region by the printing head. Ink receptacle members for absorbing the ink ejection during preparatory ejection is provided between the capping means 1220 and the printing region and the opposite side thereof. It should be noted that an ink holding member is provided in the ink receptacle member, which ink holding member is formed of a sponge like porous member or so forth.

Between a position of the capping means 1220 and the printing region, a wiping means, i.e. a wiper blade 70, which is capable of sweeping or wiping the ejection opening forming surface of the printing head 1100, is arranged for wiping off a water droplet, dust and so forth depositing on the ejection opening forming surface.

Ink supply for the printing head 1100 is performed by two stage construction with a sub-tank of an ink supply unit 1130 and a main tank of an ink supplementing unit 1140, as discussed later. The ink is supplied to a flexible ink tube from the supply unit 1130 to the printing head 1100. The ink tube is guided the motion thereof associating with scanning of the head by means of a guide member 1110.

First Embodiment

Figure 5:
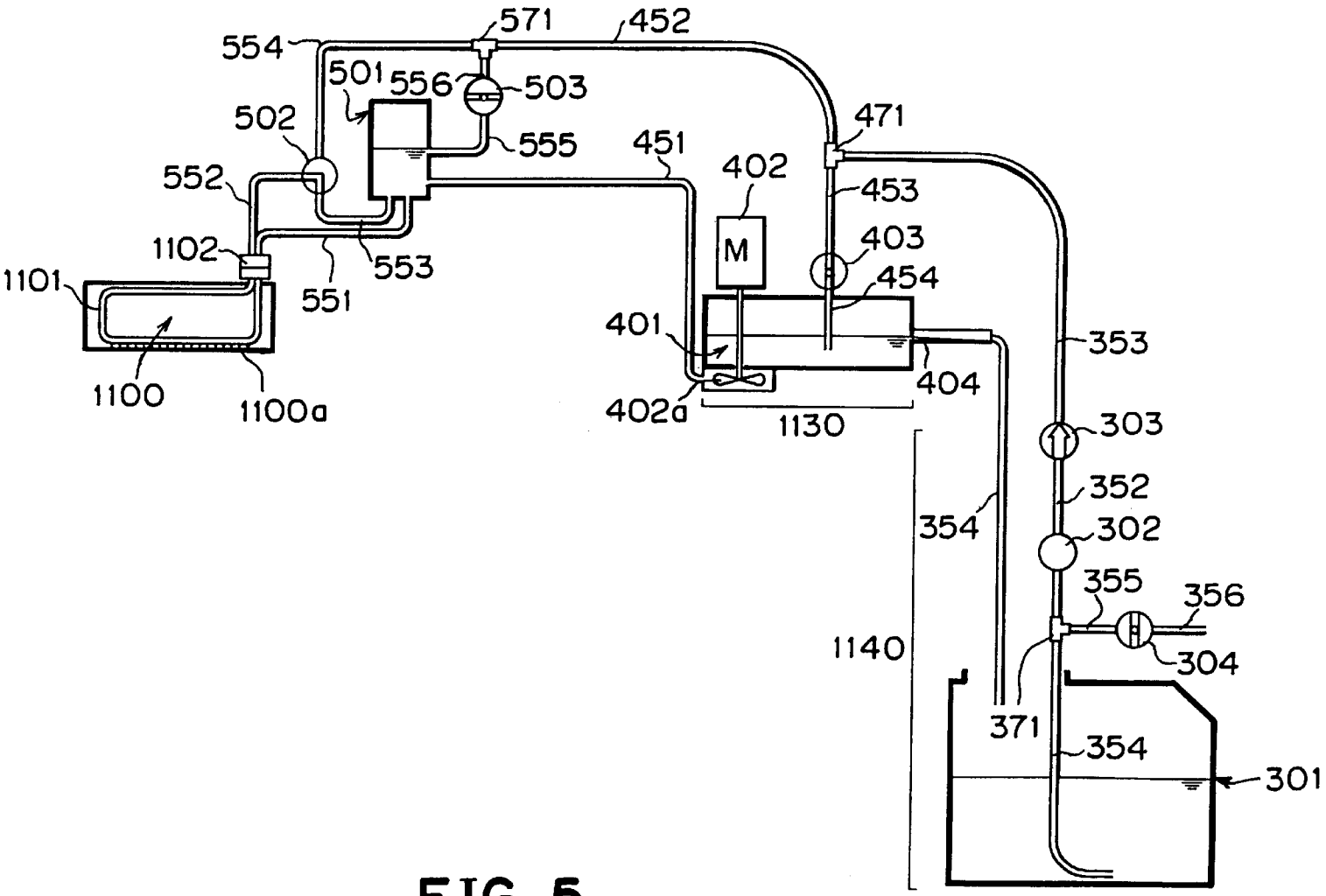
FIG. 5 is a diagrammatic illustration showing a construction of the first embodiment of an ink supply system according to the present invention.

FIG. 5 is a diagrammatic illustration showing the first embodiment of an ink supply system according to the present invention.

The ink supply system of the present invention is generally constructed with an ink-jet head 1100, a sub-tank 401 storing the ink to be supplied to the head 1100, a main tank 301 storing the ink to be supplied to the sub-tank 401 and an ink tube and so forth connecting between these elements.

Supply of the ink from the main tank 301 to the sub-tank 401 is performed through tubes 351, 352, 353 and 453. In a supply path constituted of these tubes, a pump 302 and a check valve 303 are provided. In addition, in the vicinity of the sub-tank 401 in the supply path, a two-way valve 403 is provided for opening and closing the supply path. Further, in the vicinity of the main tank 301, an atmosphere communication tubes 355 and 356 and a communication valve 304 are connected to a tube 351 via a branching joint 371. The communication between the tubes 355 and 356 is established and blocked by means of the communication valve 304.

At the intermediate position in the supply path, tubes 452, 554 and 552 are connected to each other through a branching joint 471. A supply path constituted by these tubes 452, 554 and 552 is connected to the ink-jet head 1100. In addition, between the sub-tank and the ink-jet head, a supply path constituted of a tube 551, an air buffer 451 and a tube 451 is connected.

A tube 555 having one end connected to the air buffer 501 and opened thereto at a level corresponding to a predetermined ink level in the air buffer, is connected to one side of a two-way valve 503. The other side of the two-way valve 503 is connected to a tube 556. The other end of the tube 556 is connected to the supply path constituted of the tubes 452 and so forth via a branching joint 571. Further, a tube 553 which is connected to the bottom portion of the air buffer 501 at one end thereof is connected to path including tubes 552 and so forth via a three-way valve 502.

In the sub-tank 401, a fan 402*a* for pressurizing the ink supplied via the tube 451 and so forth, and a motor 402 for driving the fan 402*a* are provided. Also, a drain 404 is provided for the sub-tank 401 for discharging or draining the ink in excess of a predetermined level. A tube 354 is connected to the drain 404 at one end and opens to the main tank 301 at the other end.

Figure 6:
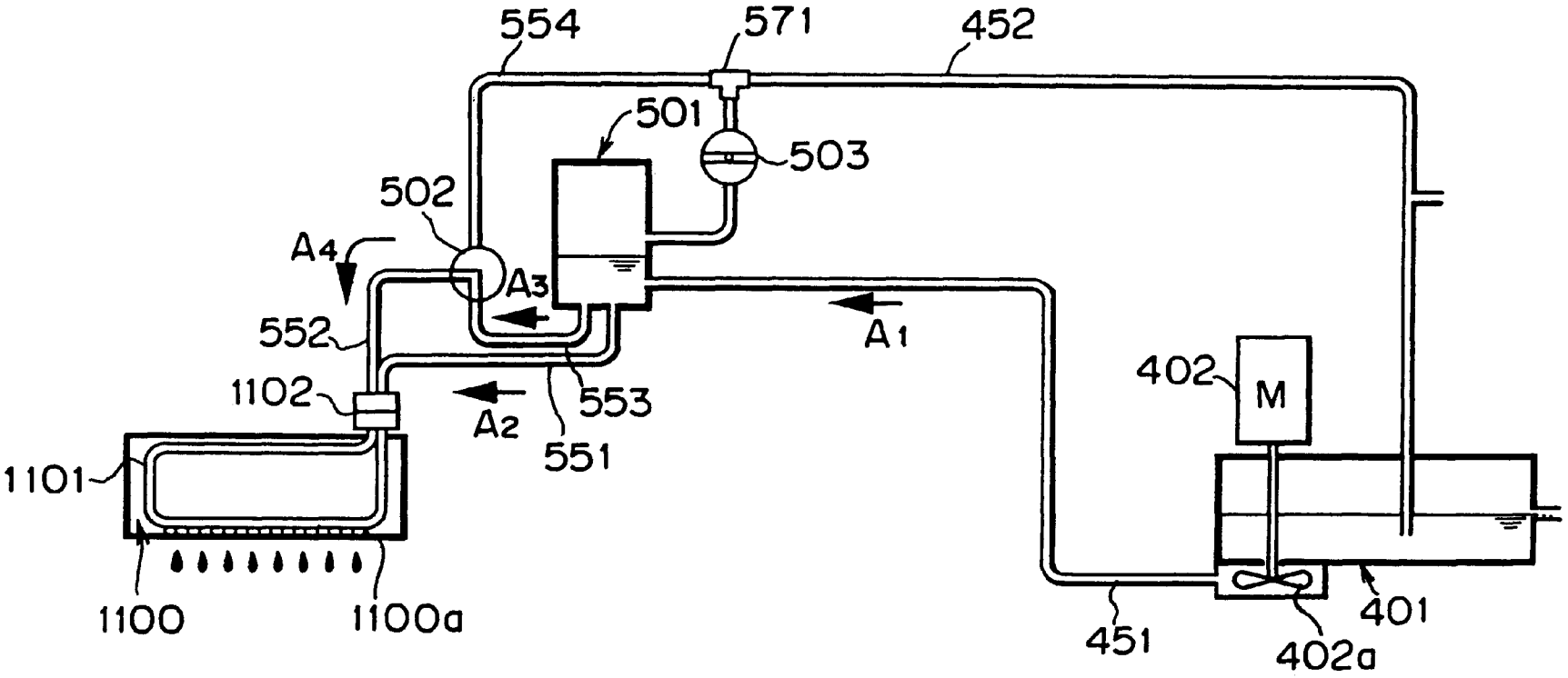
FIG. 6 is a diagrammatic illustration showing an ink supply system from a sub-tank to a printing head and illustrating an ink supply operation upon ejecting of the ink.

FIG. 6 is a diagrammatic illustration for explaining operation of the first embodiment of the ink supply system shown in FIG. 5.

In the normal printing operation, by a negative pressure generated associating with ejection of ink by the printing head 1100, the ink is supplied to the printing head 1100 from the sub-tank 401 via the tube 451, the air buffer 501 and the tube 551. In addition, a part of the supplied ink is branched from the air buffer 501 to the tubes 553 and 553 to be supplied to the printing head 1100. In response to the ink supply as set forth above, the printing head 1100 ejects ink through the ejection openings 1100*a* to perform printing on the cloth 1 (see FIG. 2). In this ink supply, when bubble is admixed in the ink, the bubble can be successfully trapped in the air buffer 501 and accumulated at the upper portion of the air buffer. Therefore, ejection failure due to occurrence of bubble in the ink can be successfully prevented.

However, when the amount of bubble accumulated in the air buffer is gradually increased to fill up the air buffer, the bubble may be finally supplied to the printing head via the tube 551 and so forth. For avoiding this, it is necessary to regularly adjust the air amount in the air buffer. The process of adjustment is as follow.

By driving the pressurizing motor 402 of the sub-tank 401, the ink in the ink supply path is pressurized. By this, the ink flows through the paths similar to those upon supplying the ink, and thus fed in the directions shown by arrows A1, A2, A3 and A4 under pressure and extruded through the ejection openings 1100*a* of the printing head 1100.

Figure 7:
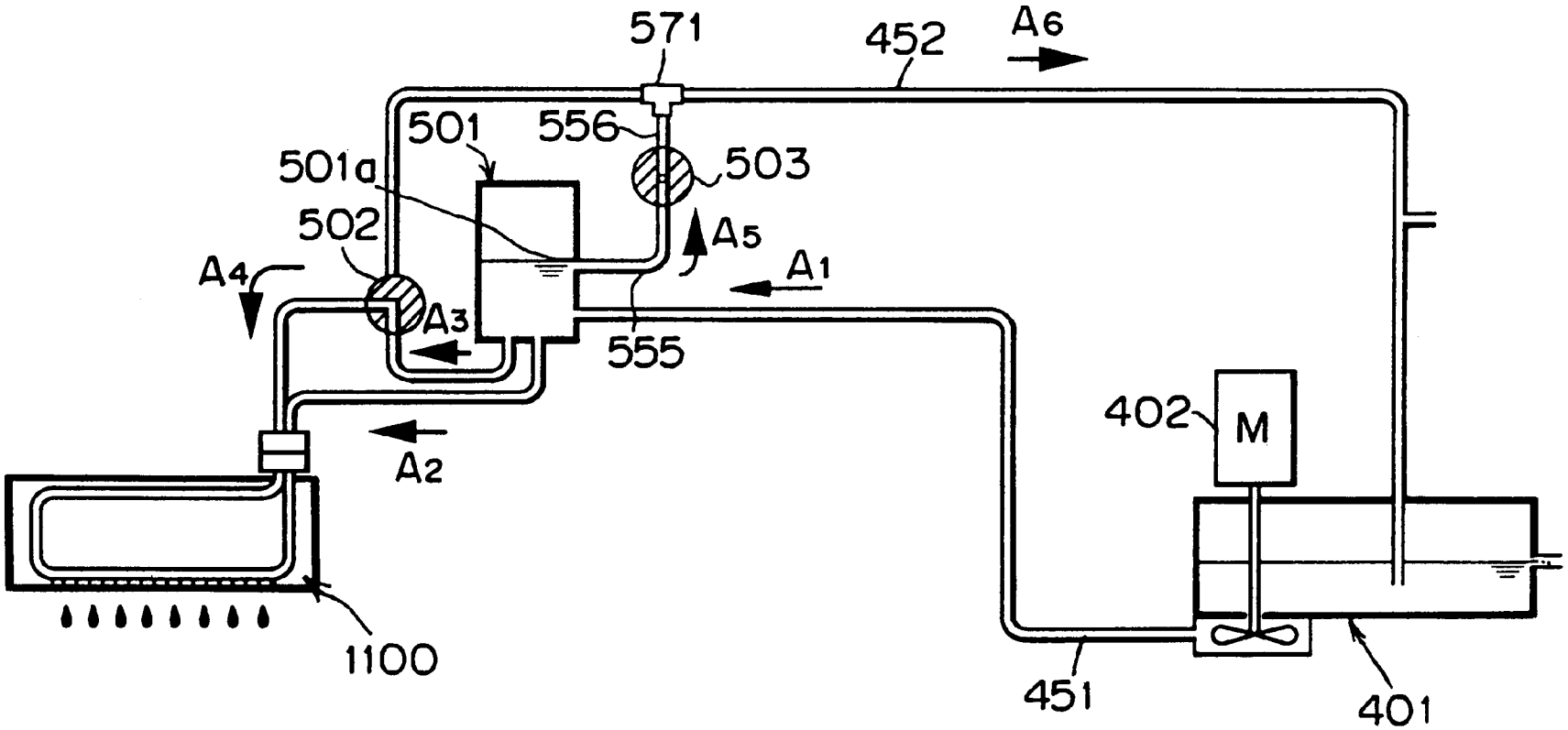
FIG. 7 is a diagrammatic illustration showing an operation of an ink level adjustment in an air buffer in the ink supply system of FIG. 6.

At this condition, as shown in FIG. 7, the adjusting valve 503 is opened to establish communication therethrough. By this, due to pressure of the ink, the ink level in the air buffer is increased to become excessive. Then, the air accumulated in the air buffer is fed to the sub-tank through the tubes 555, 556, the branching joint 571 and the tube 452 in the direction shown by arrows A5 and A6. The air introduced into the sub-tank 401 is discharged out of the apparatus, since the sub-tank 401 is opened to the atmosphere.

Thus, the air in the air buffer 501 is discharged gradually. When the ink level reaches the level of the connecting opening 501*a* with the tube 555 through the discharging operation, then the ink is introduced into the sub-tank 401 via the tube 555, 556, the branching joint 517 and the tube 452. As a result, the air in the air buffer 501 can be maintained in substantially constant amount.

Thus, in the shown embodiment, the ink which has been discharged from the printing apparatus upon adjustment of the ink level in the air buffer in the prior art, can be returned to the sub-tank as the ink supply means. Therefore, it becomes possible to reduce the amount of ink to be consumed.

In addition, by driving the pressurizing motor 402 in the condition where the adjusting valve 503 is closed, the ink pressure can be utilized for recovering operation as means for preventing plugging for the printing head. Thus, by control of the adjusting valve 503, both of pressurization of the ink and adjustment of the ink level in the air buffer can be efficiently performed.

Next, discussion will be given for ink discharging operation upon exchanging of the printing head constructed as shown in FIG. 6.

In FIG. 6, upon exchanging of the printing head, an ink joint 1102 is disconnected, and the ink joint of the printing head to be newly loaded is connected. At this time, in a path 1101 of the new printing head, a filler agent for storage is filled. At this condition, by driving the pressurizing motor 402, the pressure in the ink in the ink supply path is increased. Thus, the ink is fed under pressure in the directions of A1, A2, A3 and A4. By this, in the ink path 1101 of the printing head, the ink flows into from both sides. Then, the filler agent filled in the ink path 1101 is discharged out of the head through the ejection openings. Accordingly, by performing the ink pressurizing operation for a given period, the filler agent in the printing head 1100 can be replaced wit the ink supplied from the sub-tank 401.

Figure 8:
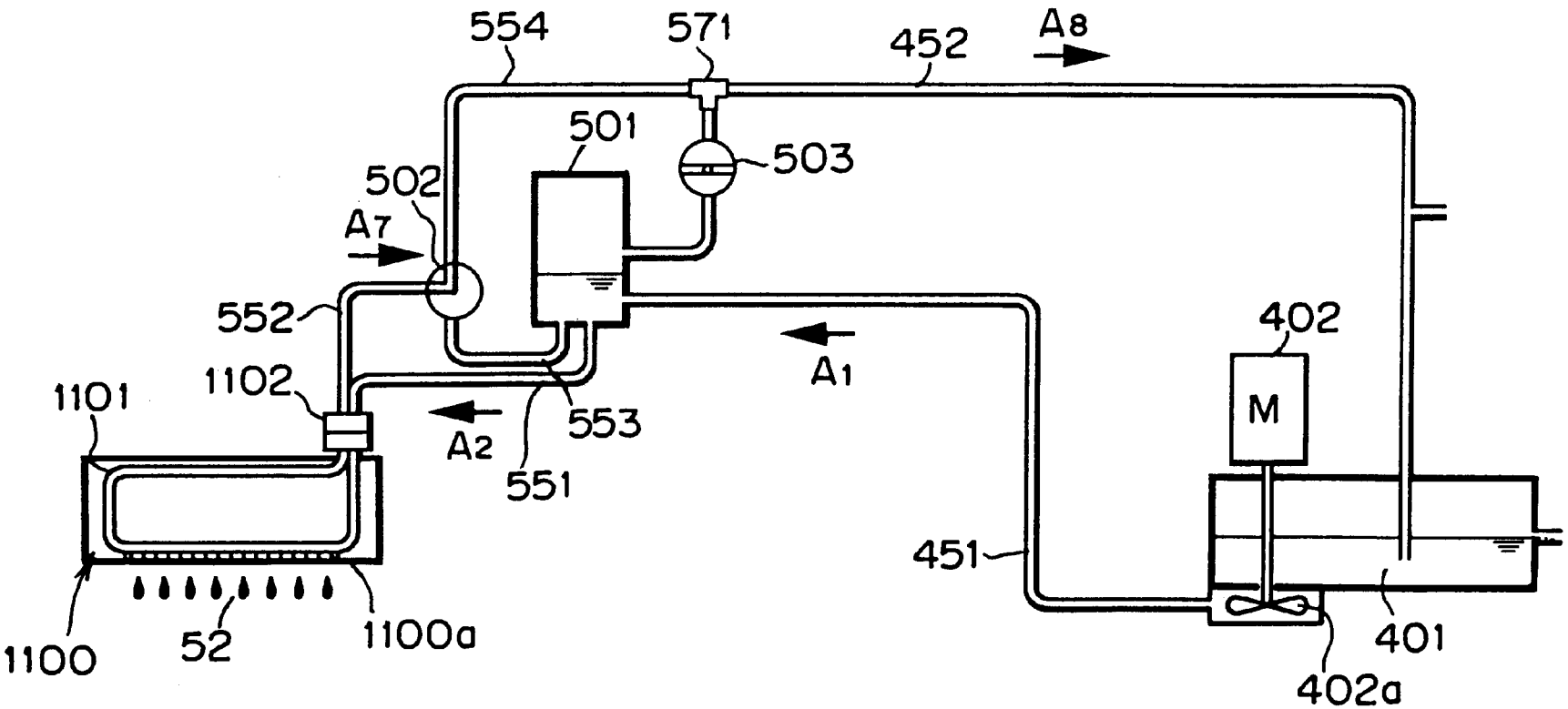
FIG. 8 is a diagrammatic illustration showing an operation of removal of air in the printing head in the ink supply system shown in FIG. 6.

It should be noted that, as shown in FIG. 8, by switching the valve position of the three-way valve 502, communication between the tube 552 and the tube 553 can be blocked and communication between the tube 552 and the tube 554 can be established. At this condition, by driving the pressurizing motor 402 a part of the ink in the printing head 1100 is discharged out of the head similarly to the prior art, and the bubble staying in the ink flow path 1101 is introduced into the sub-tank 401 together with the ink through the tube 552, the three-way valve 502, the tubes 554 and 452 (in the directions A7 and A8 in the drawing).

Thus, by arranging the valve performing blocking control of the ink in the ink supply path between the printing head and the sub-tank, the air discharging operation similar to the prior art can be performed. In addition to this, by switching the valve position of the three-way valve 502 as set out with respect to FIG. 6, the filler agent in the head can be removed upon exchanging of the head.

Further, as the shown embodiment, by making the ink discharge path for driving the ink for ink level adjustment in the air buffer and the ink discharge path from the printing head in common by employing the joint 571 and with the tube 452, overall tubing amount can be reduced to permit down-sizing of the overall apparatus.

Second Embodiment

Figure 9:
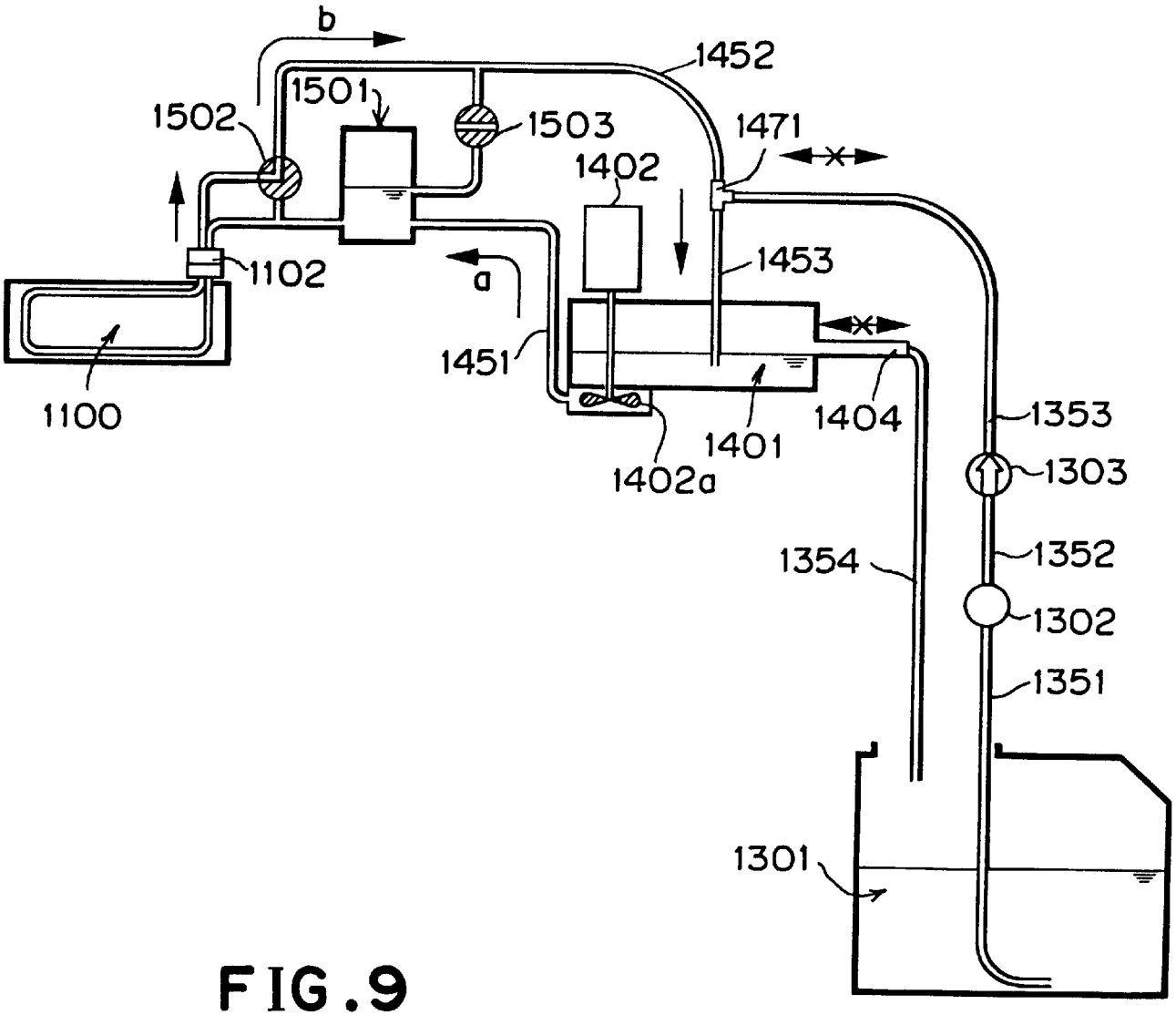
FIG. 9 is a diagrammatic illustration of the second embodiment of the ink supply system according to the invention, for explaining an ejection recovering operation.
Figure 10:
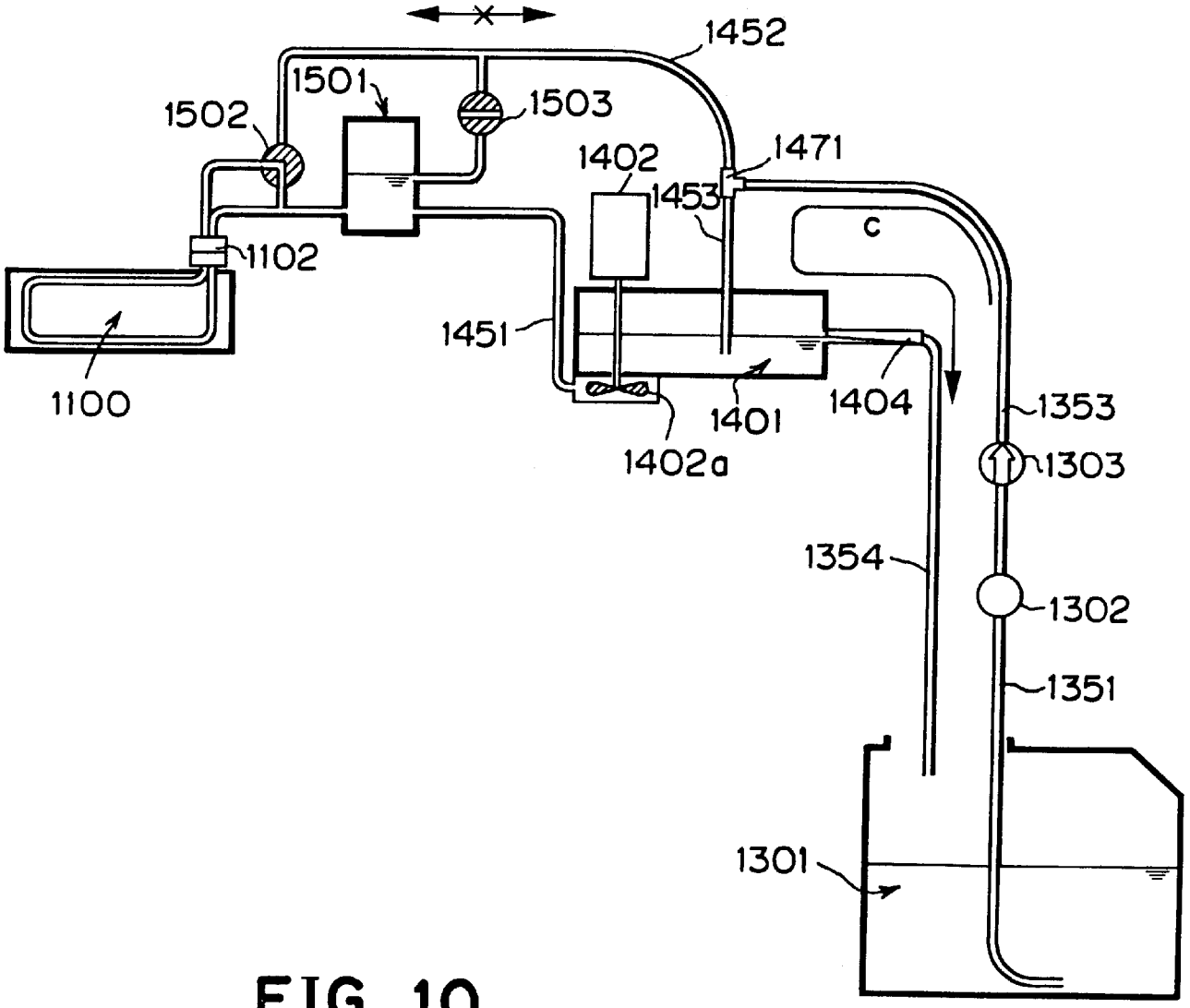
FIG. 10 is a diagrammatic illustration for explaining ink filling operation in the second embodiment of the ink supply system.

FIG. 9 is a diagrammatic illustration showing a detailed construction of the second embodiment of the ink supply system 1130 according to the invention. FIG. 10 is a similar drawing, but while FIG. 9 shows a condition where the ink is recirculated as one of the ejecting recovering process in the printing head 1100, FIG. 10 shows a condition of ink supply to a supply tank 1401 as a second container from an ink supplementing tank 1301 as a first container. The ink supply system shown in these figures are arranged in a positional relationship wherein the upper portion in the drawing is vertically upper portion and the lower portion in the drawing is vertically lower portion in the condition where the shown embodiment of the cloth printing apparatus are installed.

Figure 11:
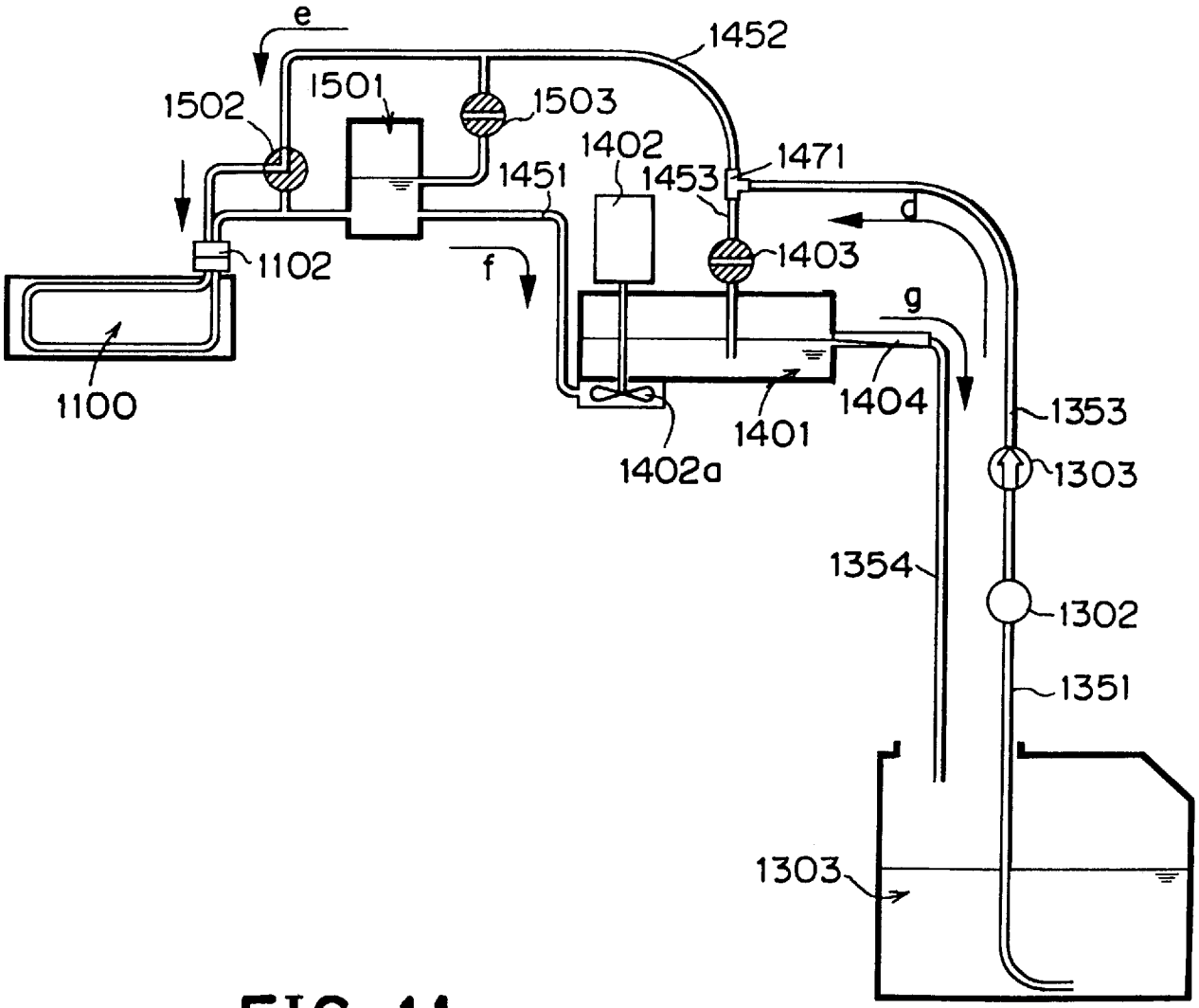
FIG. 11 is a diagrammatic illustration for explaining an ink filling operation upon exchanging of the ink in the second embodiment of an ink supply system.
Figure 12:
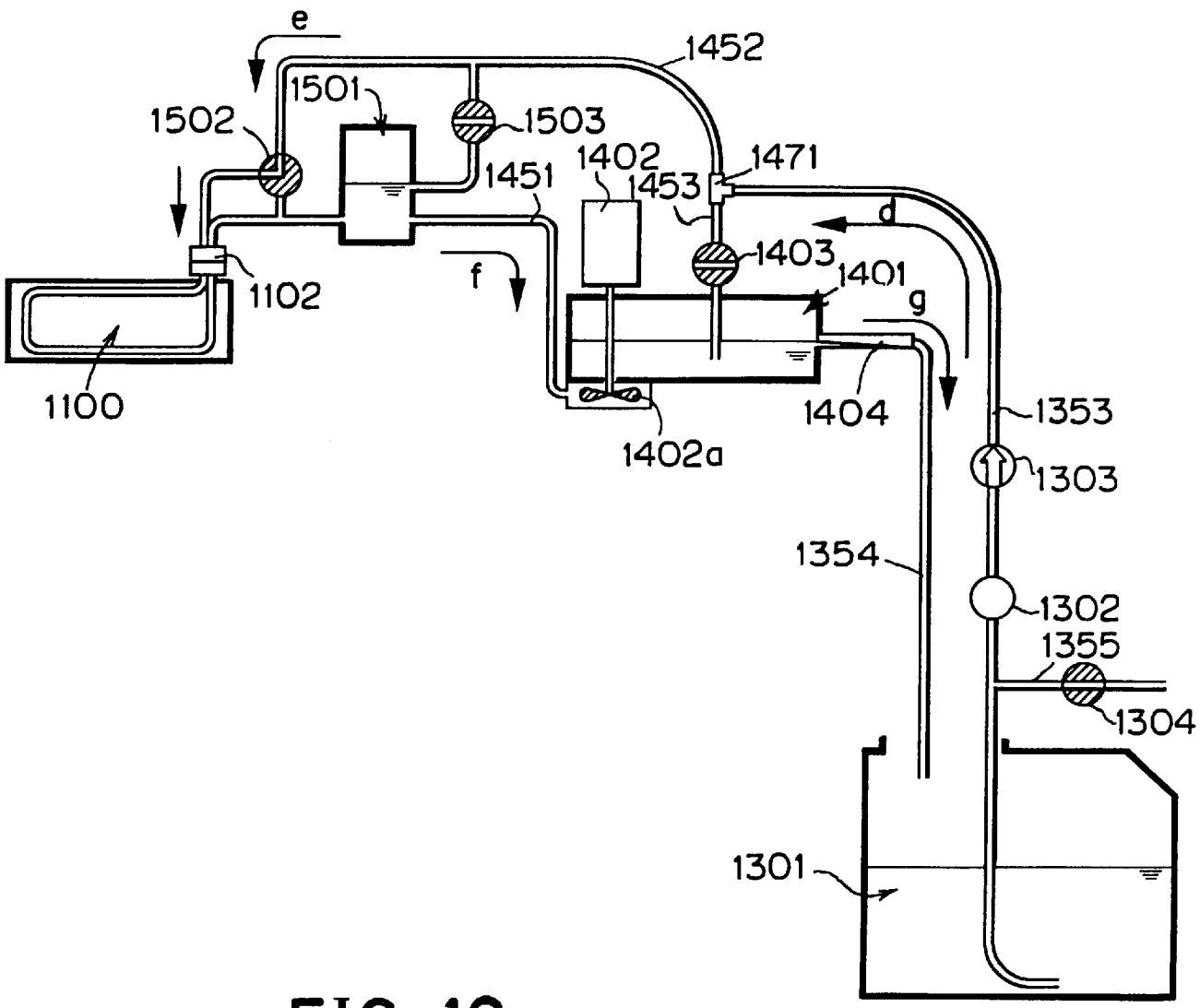
FIG. 12 is a diagrammatic illustration showing ink discharging operation upon exchanging of ink in the second embodiment of the ink supply system.

It should be noted that the ink supply system as shown in FIGS. 9 and 10 is provided with elements which are illustrated in FIGS. 11 and 12. There element, however, is omitted from FIGS. 9 and 10 for simple illustration.

As shown in FIGS. 9 and 10, an ink supplementing path 1353 and an excess ink path 1354 are provided between an ink supplementing tank 1301 and an ink supply tank 1401. At the intermediate portion of the ink supplementing path 1352, an ink supplementing pump 1302 and a check valve 1303 are provided in series. The excess ink path 1354 is connected to an overflow drain 1404 provided at a predetermined ink level in the ink supply tank 1401 at one end, and forms the path extending downwardly in substantially vertical direction to reach the other end in the ink supplementing tank 1301.

For the ink supply tank 1401, a pressurizing motor 1402 and a turbine 1402*a* driven by the motor 1402 are provided. By this, the ink in the tank 1401 can be fed toward the printing head under pressure. The ink supply tank 1401 and the printing head 1100 are generally connected to each other with a pressuring path 1451 and a discharging path 1452. At the intermediate position in the pressurizing path 1451, an air buffer 1501 is provided. In addition, between the pressurizing path 1451 and the discharging path 1452, a three-way valve 1502 which can selectively establish the ink flow path is provided. Also, between the discharging path 1452 and the air buffer 1501, a two-way buffer valve 1503 is similarly provided.

Operations of the ink circulation, the ink supply and so forth on a basis of a construction set forth above will be discussed below.

FIG. 9 shows an ink recirculating operation in the printing head. In FIG. 9, the ink in the ink supply tank 1401 is pressurized by the turbine 1402*a* driven by the pressurizing motor 1402 and fed into the printing head 1100 connected to a head connecting portion 1102 via the pressurizing path 1451 and the air buffer 1501, under pressure. The pressurized ink introduced into the head circulates therein, and in conjunction therewith is slightly discharged through the ink ejection opening of the printing head. Subsequently, the circulating ink is returned to the ink supply tank 1401 via the head connecting portion 1102 and the discharge path 1452 as shown by arrow b in FIG. 9.

At this time, the valve position of the three-way valve 1502 is switched to return the ink recirculated from the printing head 1100 to the discharge path 1452. The air buffer 1501 is adapted to avoid influence of vibration induced when the pressurizing path 1451 is moved following to the scanning motion of the printing head 1100 or when the path 1451 is moved upon pressurizing by the turbine. Also, the buffer valve 1503 is opened and closed for adjusting the air amount in the air buffer 1501.

It should be noted that upon ejection of the ink in the printing head, the three-way valve 1502 is closed and the ink is supplied by pressure difference between the printing head 1100 and the supply tank 1401 only through the pressurizing path 1451. However, it is possible to supply the ink through both of the pressurizing path 1451 and the discharging path 1452.

FIG. 10 shows an operation for supplementing the ink from the supplementing tank 1301 to the supply tank 1401. Upon supplementing the ink from the supplementing tank 1301 to the supply tank 1401, both of the three-way valve 1502 and the buffer valve 1503 are initially closed to block flow of the ink between the pressurizing path 1451 and the discharging path 1452. Next, the ink in the supplementing tank 1301 is sucked by the supplementing pump 1302, and fed to the supply tank 1401 via the supplementing path 1353, the connecting portion 1471 and the supplementing path 1453.

As the supplementing pump 1302, a diaphragm pump having a not shown check valve may be employed. However, as shown, the check valve 1303 may be provided separately from the pump. By the check valve, surge flow of the ink to the supplementary tank due to pressure difference between the pressurizing path and the discharging path.

For the supply tank 1401, the overflow drain 1404 is provided. Thus, the excessive amount of ink introduced into the supply tank by the supplementary pump can be returned to the supplementary pump at the lower position via the overflow drain and the excess ink path 1354.

As set forth above, in the shown embodiment, since the ink can be supplemented to the supply tank from the discharging path by means of the supplementary pump with closing the valves 1502 and 1503 provided between the discharging path and the ink-jet head as shown by arrow c in FIG. 10. Therefore, a path to the supply tank can be simplified. Then, the overflown ink may directly return the supplementary tank which is located at the lower position than the supply tank. This wasting of ink by discharging the overflown ink, or necessity of re-filling the collected into to the supplementary tank can be avoided.

FIG. 11 is a diagrammatic illustration showing a construction which facilitate exchanging of the ink in the above-mentioned ink supply system.

As shown in FIG. 11, between the connecting portion 1471 on the discharging path 1452 shown in FIGS. 9 and 10 and the supply tank 1401, a stop valve 1403 which can stop movement of the ink is provided.

When the stop valve 1403 is closed as shown, the ink in the supplementary tank 1301 can be supplied and can fill an ink path constituted by the supplementary path 1353, the discharging path 1452, the printing head 1100, the pressurizing path 1451 and the ink supply tank 1401 by the supplementing pump 1302, as shown by arrows d, c and f in FIG. 11.

As a result, in supplement of the ink upon exchanging of the ink, by closing the valve provided between the discharge path and the supply tank, the ink can be supplied to overall ink supply system by means of the supplementary pump provided in the ink supply system without employing the external device.

FIG. 12 is a diagrammatic illustration for explaining constriction for discharging the ink from the ink supply system upon exchanging of the ink, before filling of the ink as discussed with respect to FIG. 11.

On the path from the supplementary tank 1301 to the supplementary pump 1310, an atmosphere communicating portion 1355 connected thereto. To the atmosphere communicating portion 1355, an atmosphere valve 1304 is provided for switching between establishing and blocking communication to the atmosphere is provided.

When the atmosphere valve 1304 is held in the opened communicating condition as shown in FIG. 12, the atmosphere communication path 1355 is opened to the atmosphere to introduce the air from the atmosphere. At this condition, when the supplementary pump 1302 is driven, the air fills the path to the supply tank 1401 through the supplementary path 1353, the discharging path 1452, the ink-jet head 1100, the pressurizing path 1451. By this, the ink in the supply system is forced out to be discharged to the supply tank 1401 or the supplementary tank 1301.

With the construction set forth above, by opening the valve of the atmosphere communication path provided between the supplementary tank and the supplementary pump, the air can be pushed out to discharge the ink in the supply system by driving of the supplementary pump provided in the overall ink supply system.

Third Embodiment

The ink supply system discussed above is provided for each stage of the two stages of the printing head of the cloth printing apparatus (see FIG. 2). The shown embodiment shows a construction to supply the ink from one supplementing tank to two ink supply systems.

Figure 13:
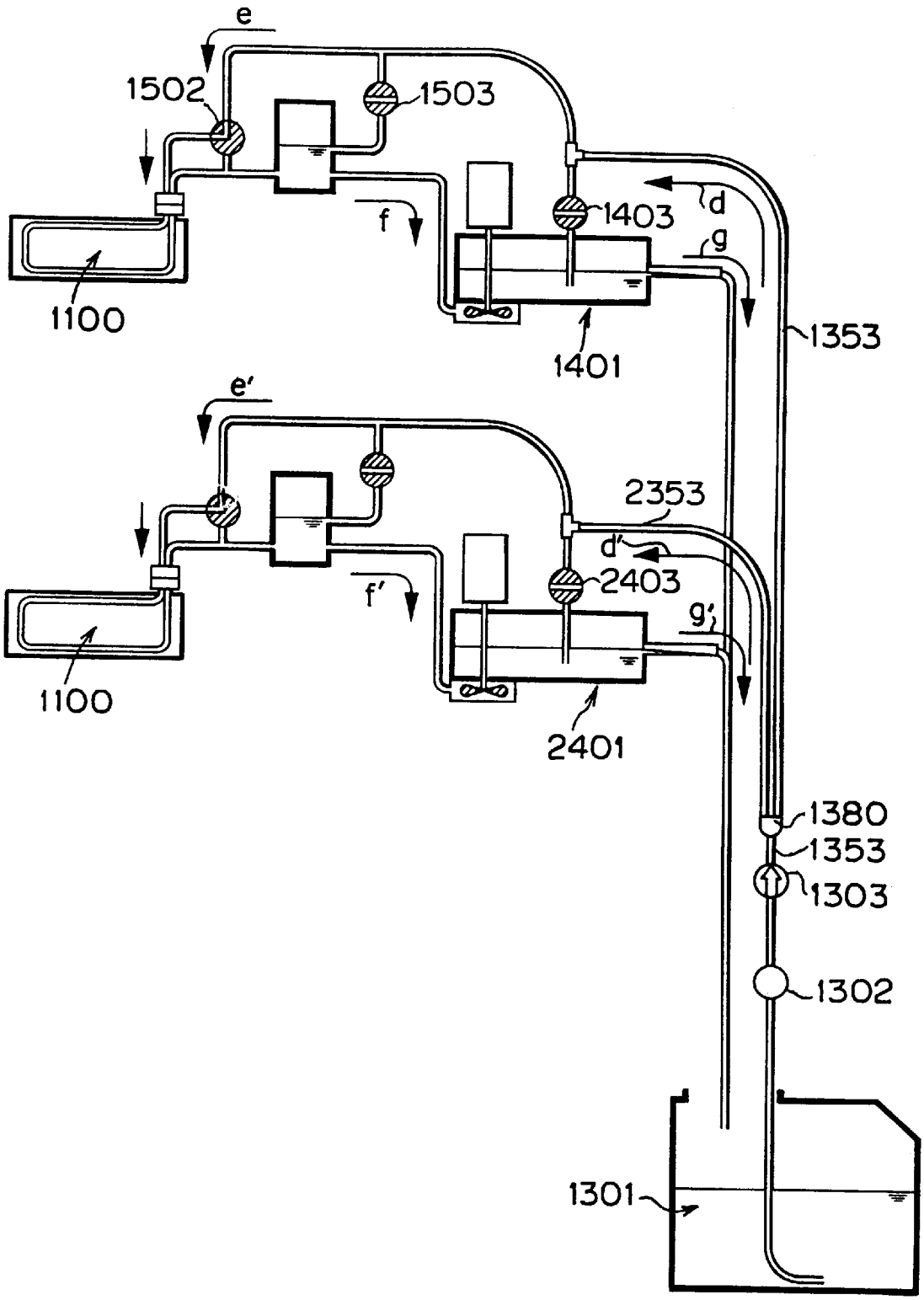
FIG. 13 is a diagrammatic illustration for explaining the third embodiment of the ink supply system.

FIG. 13 is a diagrammatic illustration showing the embodiment in the case where the ink is supplemented by single ink supplementing tank to two sets of ink supply systems.

In FIG. 13, the ink in the supplementary tank 1301 sucked by the supplementary pump 1302 is supplied into two ink supply systems with distribution to two systems by a distributing holder 1380 provided on the ink supplementing path through the ink supplementing path 1353. The operation of supply and so forth in the two ink supply systems is similar to the supply systems shown in FIGS. 9 to 12 as can be clear from FIG. 13.

As set forth above, by the shown embodiment, since the printing apparatus is constructed to supplement the ink from single supplementing tank to two supply systems, the number of component parts can be reduced. Also, as can be clear from the discussion with respect to the shown embodiment, it is also possible to supplement the ink to two or more sets of the ink supply systems from the single ink supplementing tank.

It should be noted that while the foregoing discussion has been concentrated for application of the present invention to the cloth printing apparatus in respective embodiment, the application should not be limited to the shown applications but can be applicable for the ink-jet printing to be normally employed.

Subsequently, the description will be made of the entire processes of the ink jet textile printing. After the ink jet textile printing process is executed by the use of the above-mentioned ink jet printing apparatus, the textile is dried (including the natural dry). Then, in continuation, the dyestuff on textile fabric is dispersed, and a process is executed to cause the dyestuff to be reactively fixed to the fabric. With this process, it is possible for the printed textile to obtain a sufficient coloring capability and strength because of the dyestuff fixation.

For this dispersion and reactive fixation processes, the conventionally known method can be employed. A steaming method is named, for example. Here, in this case, it may be possible to give an alkali treatment to the textile in advance before the textile printing.

Then, in the post-treatment process, the removal of the non-reactive dyestuff and that of the substances used in the preparatory process are executed. Lastly, the defect correction, ironing finish, and other adjustment and finish processes are conducted to complete the textile printing.

Particularly, the following performatory characteristics are required for the textile suitable for the ink jet textile printing:

(1) Colors should come out on ink in a sufficient density.
(2) Dye fixation factor is high for ink.
(3) Ink must be dried quickly.
(4) The generation of irregular ink spread is limited.
(5) Feeding can be conducted in an excellent condition in an apparatus.

In order to satisfy these requirements, it may be possible to give a preparatory treatment to the textile used for printing as required. In this respect, the textile having an in receptacle layer is disclosed in Japanese Patent Application Laying-open No. 62-53492, for example. Also, in Japanese Patent Application Publication No. 3-46589, there are proposed the textile which contains reduction preventive agents or alkaline substances. As an example of such preparatory treatment as this, it is also possible to name a process to allow the textile to contain a substance selected from an alkaline substance, water soluble polymer, synthetic polymer, water soluble metallic salt, or urea and thiourea.

As an alkaline substance, there can be named, for example, hydroxide alkali metals such as sodium hydroxide, potassium hydroxide; mono-, di-, and tori-ethanol amine, and other amines; and carbonate or hydrogen carbonate alkali metallic salt such as sodium carbonate, potassium carbonate, and sodium hydrogen carbonate. Furthermore, there are organic acid metallic salt such as calcium carbonate, barium carbonate or ammonia and ammonia compounds. Also, there can be used the sodium trichloroacetic acid and the like which become an alkaline substance by steaming and hot air treatment. For the alkaline substance which is particularly suitable for the purpose, there are the sodium carbonate and sodium hydrogen carbonate which are used for dye coloring of the reactive dyestuffs.

As a water soluble polymer, there can be named starchy substances such as corn and wheat; cellulose substances such as carboxyl methyl cellulose, methyl cellulose, hydroxy ethel cellulose; polysaccharide such as sodium alginic acid, gum arabic, locasweet bean gum, tragacanth gum, guar gum, and tamarind seed; protein substances such as gelatin and casein; and natural water soluble polymer such as tannin and lignin.

Also, as a synthetic polymer, there can be named, for example, polyvinyl alcoholic compounds, polyethylene oxide compounds, acrylic acid water soluble polymer, maleic anhydride water soluble polymer, and the like. Among them, polysaccharide polymer and cellulose polymer should be preferable.

As a water soluble metallic salt, there can be named the pH4 to 10 compounds which produce typical ionic crystals, namely, halogenoid compounds of alkaline metals or alkaline earth metals, for example. As a typical example of these compounds, NaCl, $Na_2SO_4$, KCl and $CH_3$ COONa and the like can be named for the alkaline metals, for example. Also, $CaCl_2$, $MgCl_2$, and the like can be named for the alkaline earth metals. Particularly, salt such as Na, K and Ca should be preferable.

In the preparatory process, a method is not necessarily confined in order to enable the above-mentioned substances and others to be contained in the textile. Usually, however, a dipping method, padding method, coating method, spraying method, and others can be used.

Moreover, since the printing ink used for the ink jet textile printing merely remains to adhere to the textile when printed, it is preferable to perform a subsequent reactive fixation process (dye fixation process) for the dyestuff to be fixed on the textile. A reactive fixation process such as this can be a method publicly known in the art. There can be named a steaming method, HT steaming method, and thermofixing method, for example. Also, alkaline pad steaming method, alkaline blotch steaming method, alkaline shock method, alkaline cold fixing method, and the like can be named when a textile is used without any alkaline treatment given in advance.

Further, the removal of the non-reactive dyestuff and the substances used in the preparatory process can be conducted by a rinsing method which is publicly known subsequent to the above-mentioned reactive fixation process. In this respect, it is preferable to conduct a conventional fixing treatment together when this rinsing is conducted.

In this respect, the printed textile is cut in desired sizes after the execution of the above-mentioned post process. Then, to the cut off pieces, the final process such as stitching, adhesion, and deposition is executed for the provision of the finished products. Hence, one-pieces, dresses, neckties, swimsuits, aprons, scarves, and the like, and bed covers, sofa covers, handkerchiefs, curtains, book covers, room shoes, tapestries, table clothes, and the like are obtained. As the methods of machine stitch to make clothes and other daily needs, a widely known method can be used.

As described above, according to the present invention, it is possible to obtain a high cleaning effect of the liquid discharging surface of the liquid discharging head as well as a long-time stability of the liquid discharging.

Thus, it is possible to produce the effect that the stable recovery can be executed even in a case where a highly viscous liquid is used or highly densified nozzles are employed, or further, an industrial use is required for a long time under severe conditions.

The present invention produces an excellent effect on an ink jet printing head and printing apparatus, particularly on those employing a method for utilizing thermal energy to form flying in droplets for the printing.

Regarding the typical structure and operational principle of such a method, it is preferable to adopt those which can be implemented using the fundamental principle disclosed in the specifications of U.S. Pat. Nos. 4,723,129 and 4,740,796. This method is applicable to the so-called on-demand type printing system and a continuous type printing system. Particularly, however, it is suitable of the on-demand type because the principle is such that at least one driving signal, which provides a rapid temperature rise beyond a departure from nucleation boiling point in response to printing information, is applied to an electrothermal transducer disposed on a liquid (ink) retaining sheet or liquid passage whereby to cause the electrothermal transducer to generate thermal energy to produce film boiling on the thermoactive portion of the printing head; thus effectively leading to the resultant formation of a bubble in the printing liquid (ink) one to one for reach of the driving signals. By the development and contraction of the bubble, the liquid (ink) is discharged through a discharging port to produce at least one droplet. The driving signal is preferably in the form of pulses because the development and contraction of the bubble can be effectuated instantaneously, and, therefore, the liquid (ink) is discharged with quicker responses.

The driving signal in the form of pulses is preferably such as disclosed in the specifications of U.S. Pat. Nos. 4,463,359 and 4,345,262. In this respect, if the conditions disclosed in the specification of U.S. Pat. No. 4,313,124 regarding the rate of temperature increase of the heating surface is preferably are adopted, it is possible to perform an excellent printing in a better condition.

The structure of the printing head may be as shown in each of the above-mentioned specifications wherein the structure is arranged to combine the discharging ports, liquid passages, and electrothermal transducers as disclosed in the above-mentioned patents (linear type liquid passage or right angle liquid passage). Besides, it may be possible to form a structure such as disclosed in the specifications of U.S. Pat. Nos. 4,558,333 and 4,459,600 wherein the thermally activated portions are arranged in a curved area.

Furthermore, as a full line type printing head having a length corresponding to the maximum printing width, the present invention demonstrates the above-mentioned effect more efficiently with a structure arranged either by combining plural printing heads disclosed in the above-mentioned specifications or by a single printing head integrally constructed to cover such a length.

In addition, the present invention is effectively applicable to a replaceable chip type printing head which is connected electrically with the main apparatus and can be supplied with ink when it is mounted in the main assemble, or to a cartridge type printing head having an integral ink container.

Furthermore, as a printing mode for the printing apparatus, it is not only possible to arrange a monochromatic mode mainly with black, but also it may be possible to arrange an apparatus having at least one of multi-color mode with different color ink materials and/or a full-color mode using the mixture of the colors irrespective of the printing heads which are integrally formed as one unit or as a combination of plural printing heads. The present invention is extremely effective for such an apparatus as this.

Now, in the embodiments according to the present invention set forth above, while the ink has been described as liquid, it may be an ink material which is solidified below the room temperature but liquefied at the room temperature or may be liquid. Since the ink is controlled within the temperature not lower than 30° C. and not higher than 70° C. to stabilize its viscosity for the provision of the stable discharge in general, the ink may be such that it can be liquefied when the applicable printing signals are given.

In addition, while preventing the temperature rise due to the thermal energy by the positive use of such energy as an energy consumed for changing states of the ink from solid to liquid, or using the ink which will be solidified when left intact for the purpose of preventing ink evaporation, it may be possible to apply to the present invention the use of an ink having a nature of being liquefied only by the application of thermal energy such as an ink capable of being discharged as ink liquid by enabling itself to be liquefied anyway when the thermal energy is given in accordance with printing signals, an ink which will have already begun solidifying itself by the time it reaches a printing medium.

In addition, as modes of a printing apparatus according to the present invention, there are a copying apparatus combined with reader and the like, and those adopting a mode as a facsimile apparatus having transmitting and receiving functions, besides those used as an image output terminal structured integrally or individually for an information processing apparatus such as a word processor and a computer.

What is claimed is:

1. An ink-jet printing apparatus using an ink-jet head and performing to a printing medium by ejecting an ink from the ink-jet head, comprising:

an ink supply means for supplying the ink to said ink-jet head;

an ink supplying path for supplying the ink from said ink supply means to the ink-jet head;

an ink returning path for discharging the ink from the ink-jet head to a portion where the ink can be supplied by said ink supply means;

an air buffer connected in said ink supplying path and storing a predetermined constant amount of air;

a guide means for guiding the ink discharged from an ink level adjusting discharge opening of said air buffer to a portion where the ink can be supplied by said ink supply means;

a pressurizing means for pressurizing the ink within said ink supplying path, said ink-jet head and said ink returning path; and a valve connected to the ink returning path and opening and closing said ink returning path.

2. An ink-jet printing apparatus as claimed in claim 1, wherein said valve is a three-way valve, in which when said ink returning path is closed, a part at an ink-jet head side of said ink returning path is connected to said ink supplying path.

3. An ink-jet printing apparatus as claimed in claim 2, wherein said guide means has a discharge path connected to said ink level adjusting discharge opening, a valve for opening and closing said discharge path, and said discharge path and a part of said ink returning path are in common.

4. An ink-jet printing apparatus as claimed in claim 3, wherein said printing medium is a cloth.

5. An ink-jet printing apparatus as claimed in claim 3, wherein said ink-jet head generates a bubble in the ink utilizing a thermal energy and perform ejection of the ink by generation of the bubble.

6. An ink-jet printing apparatus using an ink-jet head and performing printing to a printing medium by ejecting an ink from the ink-jet head, comprising:

a supply tank storing an ink to be supplied to the ink-jet head;

a supplementing tank storing an ink to be supplemented to said supply tank;

a supplementing path provided between said supplementing tank and said supply tank;

a supplementing means for feeding the ink from said supplementing tank to said supply tank via said supplementing path;

an excess ink path for guiding an excessive ink exceeding a predetermined level of the ink to said supplementing tank; and an atmosphere communication path which is connected to said supplementing path and through which said supplementing path communicates to an atmosphere via valve, and the atmospheric pressure is introduced into said supplementing path by said supplementing means in a condition communicated with the atmosphere.

7. An ink-jet printing apparatus as claimed in claim 1, wherein a supply path is provided between said supply tank and said ink-jet head, said supply path is branched from said supplementing path, and a valve for opening and closing said supplementing path is provided at a supplementing means side of a junction of said supplementing path.

8. An ink-jet printing apparatus as claimed in claim 7, wherein a valve for opening and closing said supply path is provided therein.

9. An ink-jet printing apparatus as claimed in claim 8, wherein another supply path is provided between said supply tank and said ink-jet head.

10. An ink-jet printing apparatus as claimed in claim 9, comprising a plurality of sets of said supply tank, said supplementing path, said excess ink path, the atmosphere communicating path, said junction, said valve and another supply path, the ink being supplied from a single supplementing tank to said plurality of sets.

11. An ink-jet printing apparatus as claimed in claim 9, wherein said printing medium is a cloth.

12. An ink-jet printing apparatus as claimed in claim 9, wherein said ink-jet head is adapted to generate a bubble utilizing a thermal energy and ejects the ink associating with generation of the bubble.

* * * * *